US007803859B2

(12) United States Patent
Ok et al.

(10) Patent No.: US 7,803,859 B2
(45) Date of Patent: Sep. 28, 2010

(54) NANO-SILVER INFUSED CONTAINER ARRANGEMENTS

(75) Inventors: Gil Sun Ok, Kyonggi-Do (KR); Youn Jae Lee, Kyonggi-Do (KR)

(73) Assignee: Zinus, Inc., Hayward, CA (US)

( * ) Notice: Subject to any disclaimer, the term of this patent is extended or adjusted under 35 U.S.C. 154(b) by 1260 days.

(21) Appl. No.: 11/303,783

(22) Filed: Dec. 15, 2005

(65) Prior Publication Data

US 2007/0137500 A1 Jun. 21, 2007

(51) Int. Cl.
*A47J 43/18* (2006.01)
*C08K 3/10* (2006.01)

(52) U.S. Cl. ..... 524/183; 997/778; 524/403

(58) Field of Classification Search ..... 524/81–185; 977/778–787; 99/426, 427–442
See application file for complete search history.

(56) References Cited

U.S. PATENT DOCUMENTS

D452,374 S 12/2001 Kim
6,415,947 B1 7/2002 Kim
6,499,602 B2 * 12/2002 Yajima et al. ..... 206/711
7,671,106 B2 * 3/2010 Markovich et al. ..... 521/144
2001/0042697 A1 * 11/2001 Yajima et al. ..... 206/454
2006/0196623 A1 * 9/2006 Hsiao ..... 162/161
2007/0142533 A1 * 6/2007 Ok et al. ..... 524/440

* cited by examiner

*Primary Examiner*—Daniel Robinson
(74) *Attorney, Agent, or Firm*—Imperium Patent Works

(57) ABSTRACT

Nano-silver infused container arrangements are presented including: a nano-silver infused container body defining at least one opening; and a nano-silver infused container lid configured to close off the at least one opening. In some embodiments, the arrangement is a composition of a polymeric compound and a concentration of nano-silver particles. In some embodiments, the polymeric compound includes polyvinyl-pyrrolidione, polypropylene and polycarbonate. In some embodiments, the nano-silver infused container lid includes: a lid top disposed along a plane, a gasket channel disposed along the contiguous lid wall edge, a channel opening, two opposing concave surfaces disposed perpendicular to the channel opening, and a bottom surface disposed substantially perpendicular to the two opposing concave surfaces and a compressible gasket disposed within the gasket channel and retained by the two opposing concave surfaces; and wherein, the nano-silver infused container body includes: a container bottom, a container wall, and a sealing ridge.

17 Claims, 5 Drawing Sheets

NANO-SILVER INFUSED CONTAINER ARRANGEMENTS

CROSS REFERENCE TO RELATED APPLICATIONS

The present invention is related to the following applications, all of which are incorporated herein by reference:

Commonly assigned application entitled "A NANO-SILVER INFUSED POLYMERIC COMPOSITION AND METHODS OF MANUFACTURING THE SAME," filed on even date herewith by the same inventors herein and published on Jun. 21, 2007, as U.S. Pat. Pub. No. 2007/0142533.

BACKGROUND

Plastic containers, capable of storing any number of articles of manufacture, have become ubiquitous in modern markets. Polymeric compounds are utilized to manufacture plastic containers because of their many beneficial characteristics including, for example, high durability, high ductility, and good tensile strength. Additionally, many polymeric compounds have thermal properties that allow the use of injection molding techniques to create any number of useful shapes and sizes. However, despite their broad applicability, plastic containers continue to experience some drawbacks.

For example, in some applications, polymeric compounds form micropores during manufacturing processes. These micropores may allow the passage of undesirable gases through a polymeric barrier. Thus, containers manufactured from polymeric compounds may, in some examples, suffer from undesirable contamination. One solution utilized to ameliorate polymeric porosity is the use of surface coatings. In some examples, a polymer may be surface coated with an antibacterial compound. One example of an antibacterial compound utilized for surface coatings is Biogreen as disclosed by Korean Patent Number 10-301722. While some surface coatings may be theoretically effective, they may, in some examples suffer from undesirable agglomeration during manufacture, which may result in uneven coverage and distribution. Furthermore, some surface coatings require stringent manufacturing conditions such as maintaining a non-oxygenated environment or a narrow temperature range during application. These requirements may contribute to rising manufacturing costs, which in some examples, may be undesirable.

Another drawback to plastic containers arises when sealing a plastic container opening. Typically, a gasket may be utilized in coordination with a lid to close and seal a plastic container. However, gaskets are often difficult to retain because many polymeric compounds resist adhesion. Thus, common glues and bonding agents cannot always be used to permanently affix a gasket to a container. In those examples, a gasket may easily be lost, mishandled, or damaged by a user. Thus, new methods of affixing gaskets to polymeric compounds may be desirable.

Still further, while locking mechanisms for plastic container lids are common in the prior art, most of these mechanisms rely on a contiguous locking channel indent and locking tab to lock a lid to a container. In many instances, those channels introduce undesirable crevices and surfaces that may not be easily cleaned and sanitized. Thus, a non-porous polymeric container utilizing semi-permanently affixed compressible gasket having a simplified locking mechanism may be desirable in some examples. Therefore, nano-silver infused container arrangements are presented herein.

SUMMARY

Nano-silver infused container arrangements are presented including: a nano-silver infused container body defining at least one opening; and a nano-silver infused container lid configured to close off the at least one opening. In some embodiments, the arrangement is a composition of a polymeric compound and a concentration of nano-silver particles. In some embodiments, the polymeric compound includes polyvinyl-pyrrolidione, polypropylene and polycarbonate. In some embodiments, the nano-silver infused container lid includes: a lid top disposed along a plane, the lid top having a lid top edge, a lid wall disposed substantially perpendicular to the plane along the lid top edge, the lid wall having a contiguous lid wall edge, a gasket channel disposed along the contiguous lid wall edge, the gasket channel defining, a channel opening, two opposing concave surfaces disposed perpendicular to the channel opening, and a bottom surface disposed substantially perpendicular to the two opposing concave surfaces, and a compressible gasket disposed within the gasket channel and retained by the two opposing concave surfaces; and wherein, the nano-silver infused container body includes: a container bottom disposed along a plane, the container bottom having a container bottom edge, a container wall disposed substantially perpendicular to the plane along the container bottom edge, the container wall having a contiguous container wall edge, and a sealing ridge configured to engage the compressible gasket through the channel opening. In some embodiments, the nano-silver infused container lid further includes: locking tabs flexibly connected with the contiguous lid wall edge, the locking tabs each having a lock nub; and wherein, the nano-silver infused container body further includes: a lock ridge disposed along the container wall, the lock ridge configured with a non-contiguous indent for capturing the lock nub.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION

The present invention will now be described in detail with reference to a few embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

Figure 1:
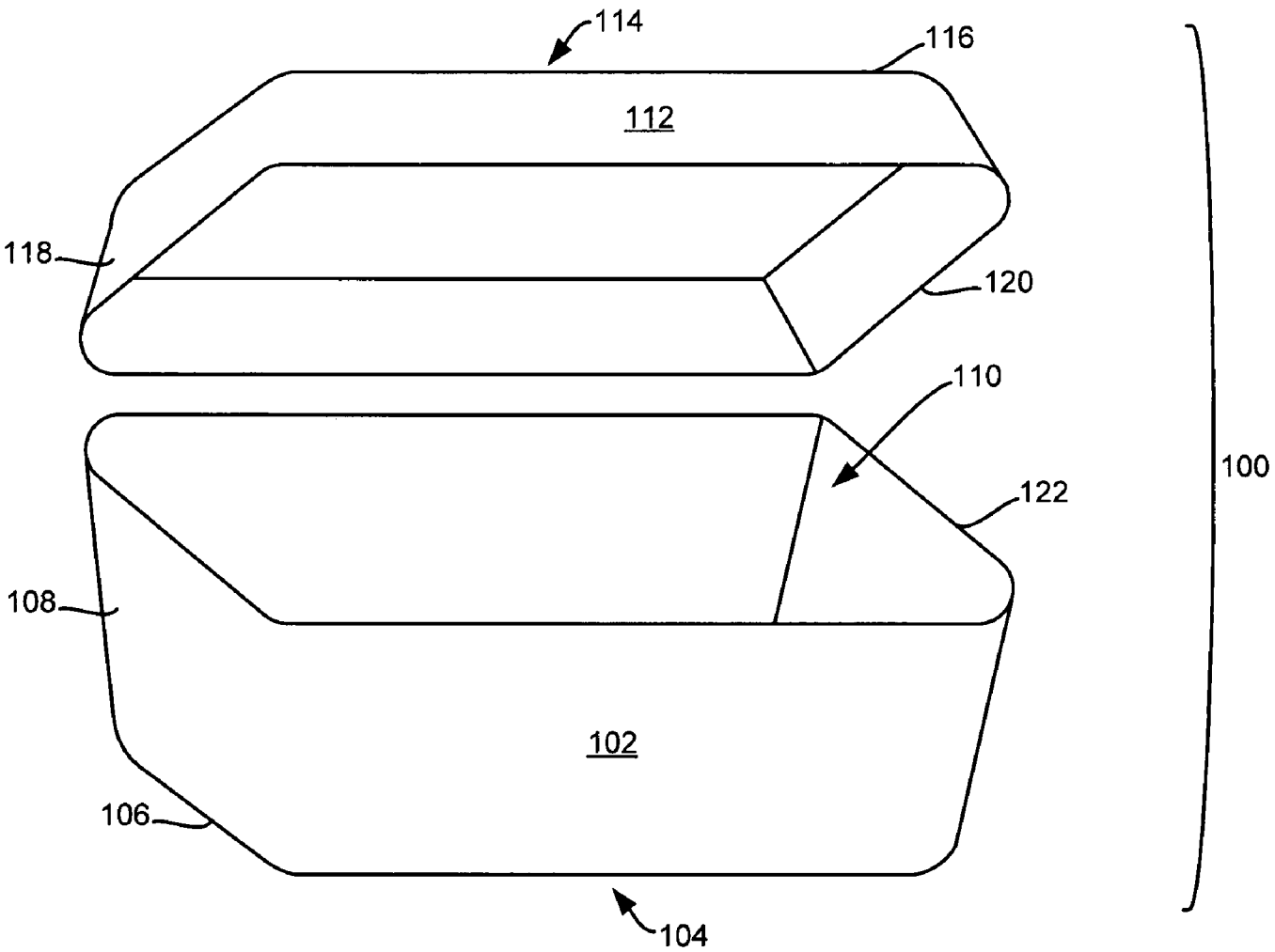
FIG. 1 is an illustrative orthogonal representation of a nano-silver infused container in accordance with embodiments of the present invention.

FIG. 1 is an illustrative orthogonal representation of a nano-silver infused container 100 in accordance with embodiments of the present invention. As may be appreciated, although embodiments described herein may have a particular shape, those shapes are not intended to be limiting. Rather, the concepts disclosed herein are provided for clarity's sake. Thus, for example, although nano-silver infused container 100 is configured as a rectangular shape, any other shape, such as, for example, circular, ovate, triangular, and the like are contemplated in embodiments of the present invention. Nano-silver infused container 100 includes a container body 102 and a container lid 112 both of which may be nano-silver infused. Nano-silver infused polymeric compounds are disclosed in U.S. patent application Ser. No. 11/305,866 entitled, "A NANO-SILVER INFUSED POLYMERIC COMPOSITION AND METHODS OF MANUFACTURING THE SAME," and published on Jun. 21, 2007, as U.S. Pat. Pub. No. 2007/0142533, which is hereby incorporated by reference in its entirety. Polymeric compounds, when combined with nano-silver particles, may result in improved antimicrobial and sealing properties. In some embodiments, polymeric compounds such as polyvinyl-pyrrolidione, polypropylene and polycarbonate may be utilized. In some embodiments, the concentration of nano-silver particles is approximately 6 to 30 ppm.

Container body 102 defines an opening 110. In some embodiments, container body may be configured with more than one opening. Container body 102 may be further configured with a container bottom 104 disposed along a plane. One skilled in the art will recognize that a container bottom may not necessarily be precisely co-incident with a described plane, but may be afforded any number of profiles without departing from the present invention. Thus, container bottom 104 may be disposed along a plane while having a domed surface in some examples. Container bottom 104 includes at least one container bottom edge 106. In circular embodiments, a container bottom may include only one edge. In rectangular embodiments like that shown, a container bottom may include four edges. Disposed along container bottom edge 106 is at least one container wall 108. Container wall 108 may be disposed substantially perpendicular to container bottom 104. In some embodiments, container wall 108 may be disposed at an angle selected to enhance release of substances held therein. Thus, in some embodiments, container wall 108 may be disposed at an angle greater than 90°. In other examples, container wall 108 may be disposed at an angle equal to or less than 90°. Like above, in circular embodiments, a container may include only one container wall. In rectangular embodiments like that shown, a container may include four container walls each disposed substantially perpendicular with respect to each other. Container wall 108 may also include a sealing ridge 122. Sealing ridge 122 may be configured to engage a compressible gasket in some embodiments. Compressible gaskets will be discussed in further detail below for FIG. 2.

Container lid 112 may be configured to close opening 10 in some embodiments. Container lid 112 may be further configured with a lid top 114 disposed along a plane. One skilled in the art will recognize that a lid top may not necessarily be precisely co-incident with a described plane, but may be afforded any number of profiles without departing from the present invention. Thus, lid top 114 may be disposed along a plane while having a domed surface in some examples. Lid top 114 includes at least one lid top edge 116. In circular embodiments, a container bottom may include only one edge. In rectangular embodiments like that shown, a container bottom may include four edges. Disposed along lid top edge 116 is at least one lid wall 118. Lid wall 118 may be disposed substantially perpendicular to lid top 114. In some embodiments, lid wall 118 may be disposed at an angle selected to enhance release of substances held therein. Thus, in some embodiments, lid wall 118 may be disposed at an angle greater than 90°. In other examples, lid wall 118 may be disposed at an angle equal to or less than 90°. Like above, in circular embodiments, a container may include only one lid wall. In rectangular embodiments like that shown, a container may include four lid walls each disposed substantially perpendicular with respect to each other. Lid wall 118 may be further configured with a contiguous lid wall edge 120 which, in turn, may also include a gasket channel. A gasket channel may be utilized to contain a compressible gasket in some embodiments. Compressible gaskets will be discussed in further detail below for FIG. 2.

Figure 2:
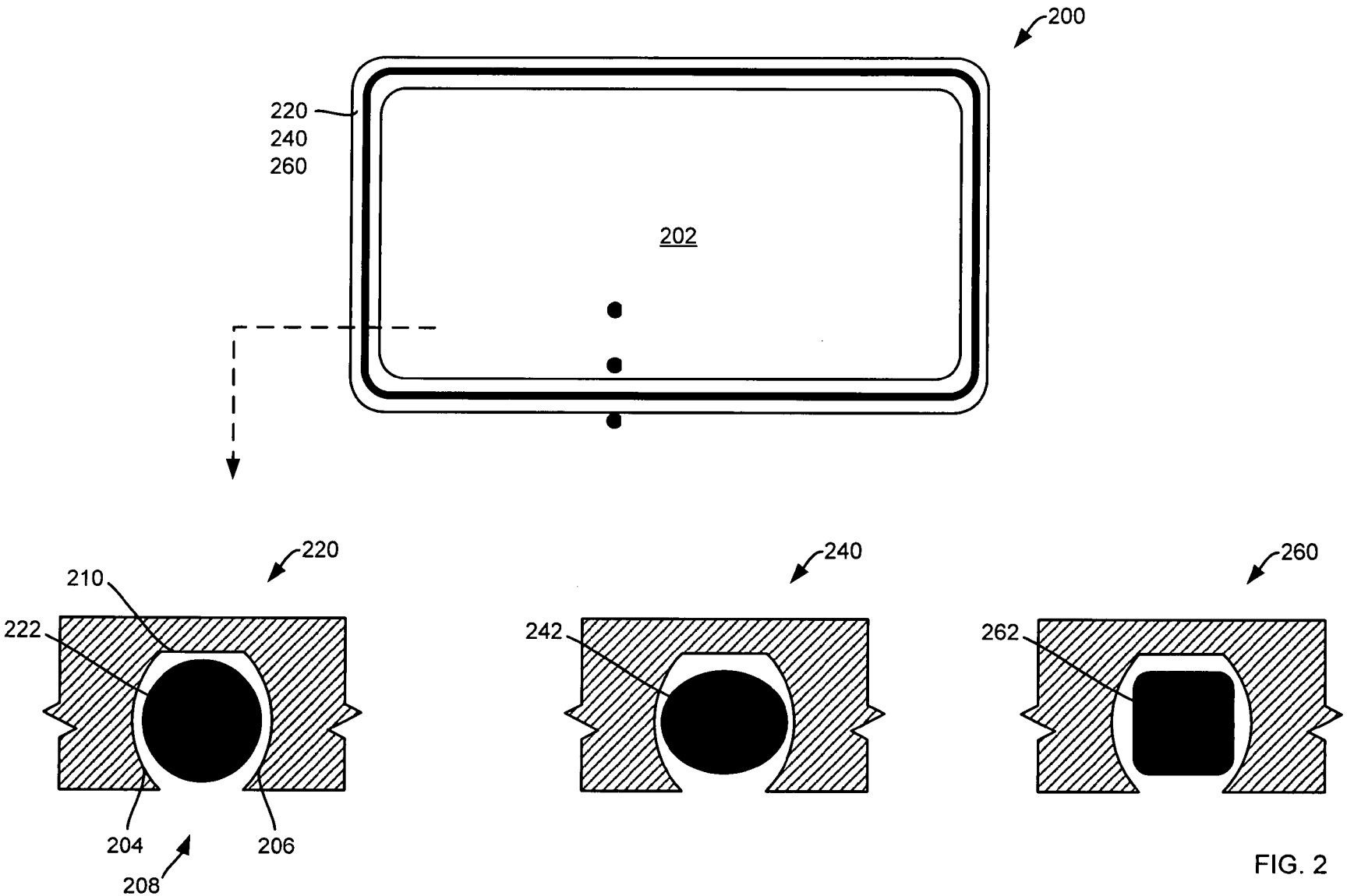
FIG. 2 is an illustrative representation of a compressible gasket sealing arrangement in accordance with embodiments of the present invention.

FIG. 2 is an illustrative representation of a compressible gasket sealing arrangement 200 in accordance with embodiments of the present invention. As noted above, a container lid 202 may be configured with a gasket channel 220, 240, and 260 that holds a compressible gasket having any number of cross-sectional profiles including: a circle, an oval, a quadrilateral, and a polygon. Use of a compressible gasket may provide advantages for storing perishable substances, or substances requiring an air-tight or nearly air-tight seal. Typically, a gasket channel may be disposed along a lid wall edge. As illustrated in cross-section, gasket channel 220 is configured with a compressible gasket 222 that is circular in cross-section profile. Gasket channel 220 defines an opening 208 configured to receive a sealing ridge in some embodiments. Gasket channel 220 further defines opposing concave surfaces 204 and 206 as well as a bottom surface 210. As may be appreciated, utilizing a gasket for sealing purposes is generally well-known in the art. As may be further appreciated, bonding a gasket to a sealing surface or surfaces may ensure retention of the gasket. However, in some examples, permanently affixing a gasket to a sealing surface may not be desirable where contamination by bonding agents may be unwanted. In other examples, it may be desirable to configure a removable gasket to facilitate cleaning or replacing. Thus, in embodiments described herein, compressible gasket 222 may be removably retained in gasket channel 200 due, at least in part to, opposing concave surfaces 204 and 206. Furthermore, gasket compressible 222 may be removed for any number of reasons including cleaning and replacing.

When compressible gasket 222 is engaged by a sealing ridge, compressible gasket 222 engages bottom surface 210 and partially compresses. Gasket compression will be discussed in further detail below for FIG. 3. As may be appreciated, gaskets may be configured in any number of profiles without departing from the present invention. For example, gasket channel 240 may be configured with a compressible gasket 242 having an oval cross-sectional profile. Further, gasket channel 260 may be configured with a compressible gasket 262 having a quadrilateral cross-sectional profile. Indeed any number of cross-sectional profiles may be utilized in embodiments described herein.

Figure 3:
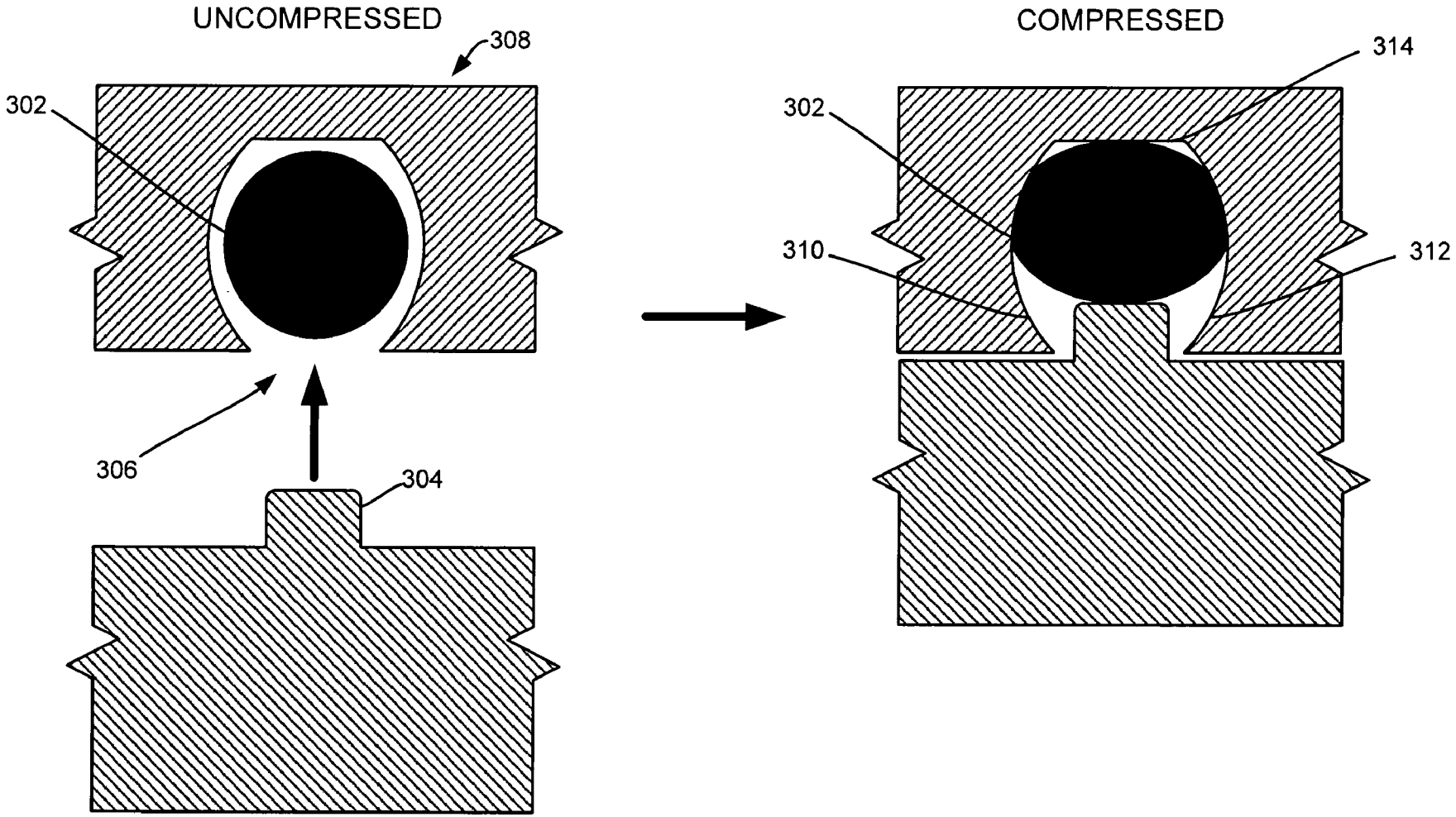
FIG. 3 is an illustrative cross-sectional representation of a compressible gasket in operation in accordance with embodiments of the present invention.

FIG. 3 is an illustrative cross-sectional representation of a compressible gasket 302 in operation in accordance with embodiments of the present invention. As can be appreciated, compressible gasket 302 may be engaged by sealing ridge 304 through opening 306. When uncompressed, compressible gasket 302 is retained in gasket channel 308. When compressed, compressible gasket 302 is engaged by sealing ridge 304 thus forming a seal with opposing concave surfaces 310 and 312 as well as with bottom surface 314. As noted above, a compressible gasket having any number of cross-sectional profiles including: a circle, an oval, a quadrilateral, and a polygon may be utilized without departing from the present invention. It may be appreciated that the illustrations provided herein are for illustrative purposes only and are not intended to provide precise scaling of embodiments described herein.

Figure 4:
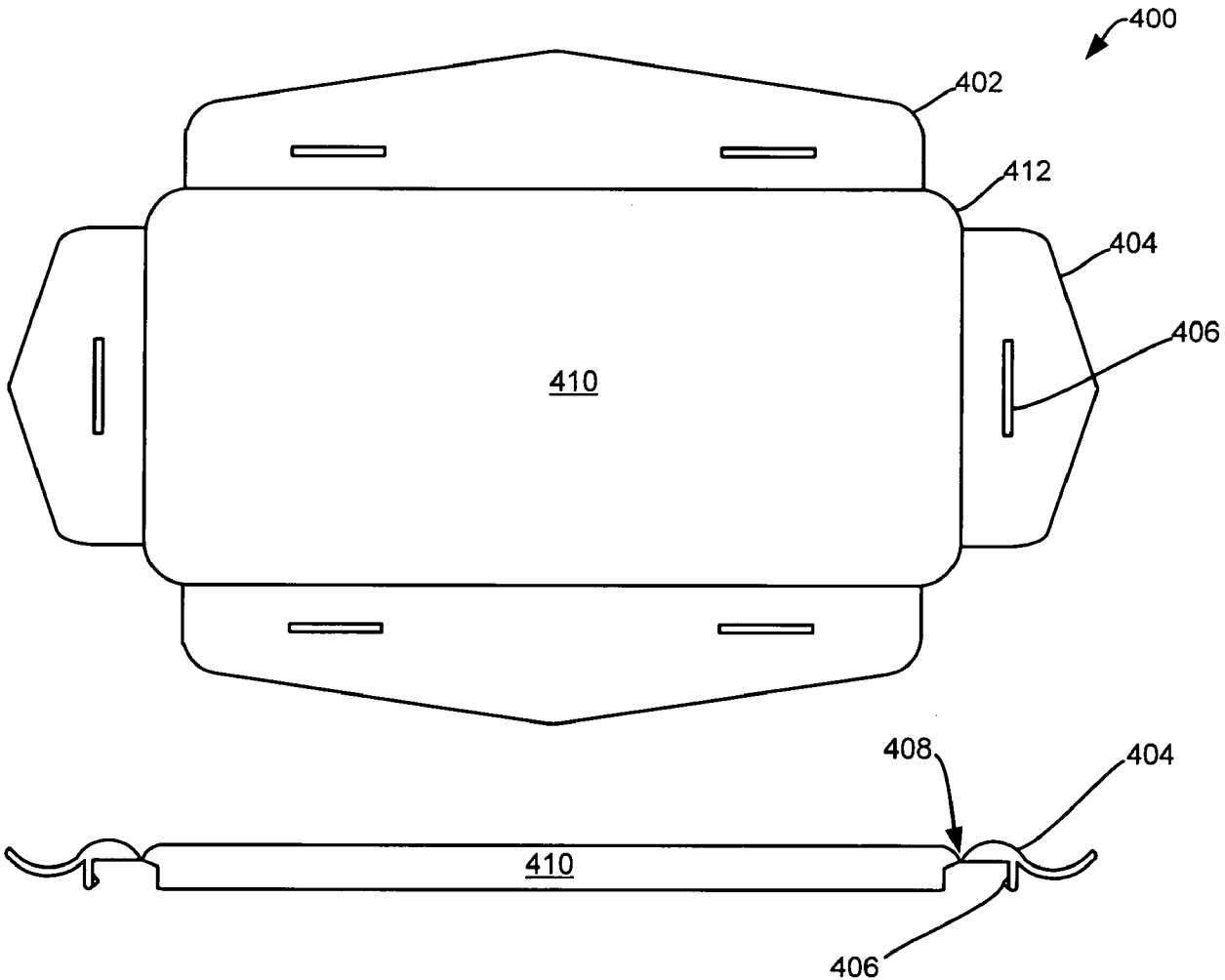
FIG. 4 is an illustrative representation of a simplified locking arrangement for use with a container in accordance with embodiments of the present invention.

FIG. 4 is an illustrative representation of a simplified locking arrangement 400 for use with a container in accordance with embodiments of the present invention. Any number of locking tabs 402 and 404 may be flexibly connected with a lid 410 along a lid wall edge 412 (see also DETAIL A—408). As noted above, in circular embodiments, a container lid may include only one lid wall edge configured with one or more locking tabs. In rectangular embodiments, like that shown, a container may include four locking tabs each disposed substantially perpendicular with respect to each other. Thus, any number of locking tabs may be utilized without departing from the present invention. Locking tab 404 may be further configured with a lock nub 406. Lock nub 406 may be configured to engage an indent. In some embodiments, a non-contiguous indent may be utilized. Non-contiguous indents may provide more sanitary conditions as contiguous indents may prove difficult to clean in some embodiments. Operation of lock nub 406 will be discussed in further detail below for FIG. 5. As may be appreciated, any number of lock nubs may be utilized. As illustrated six lock nubs are configured although more or fewer may be configured without departing from the present invention.

Figure 5:
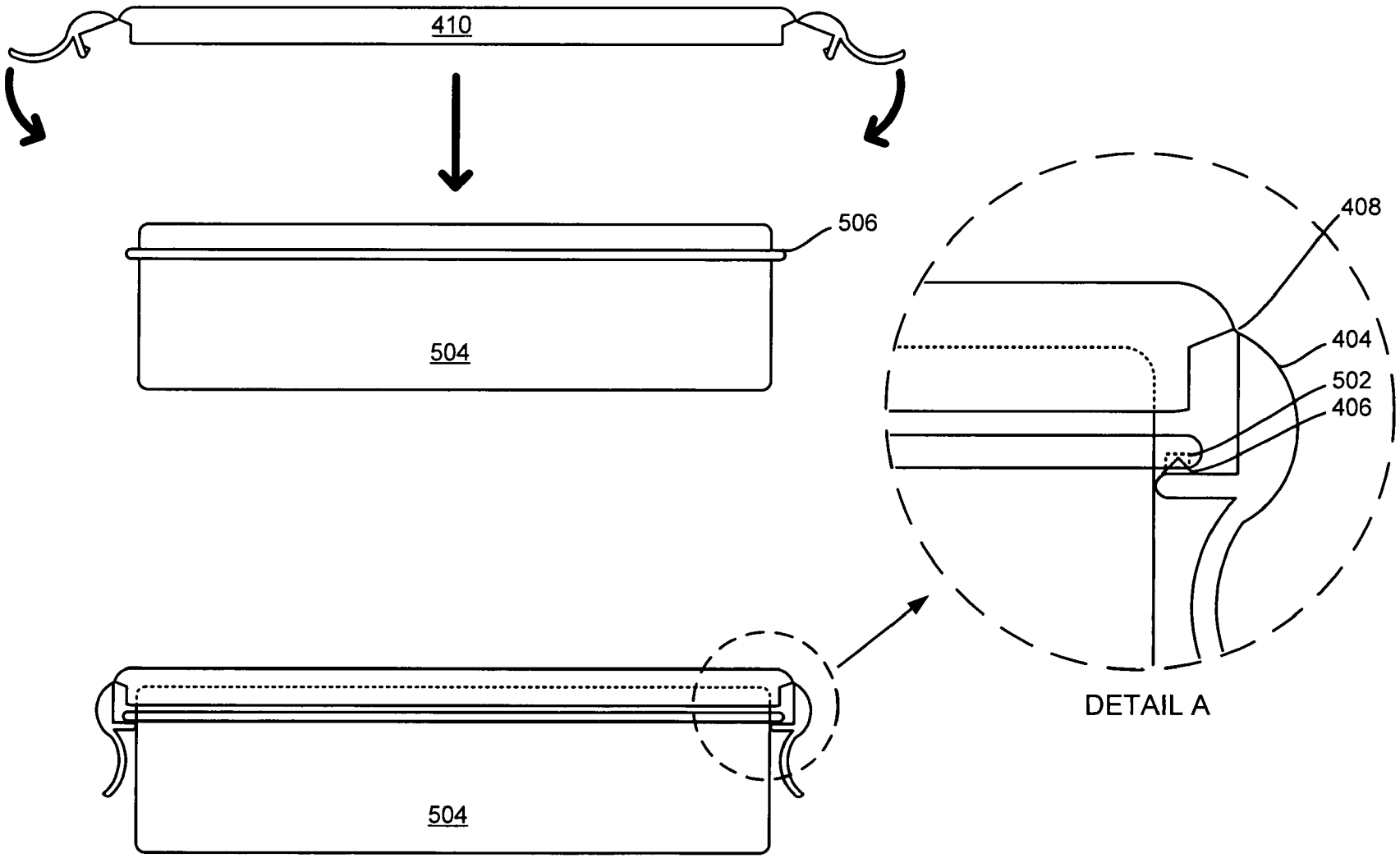
FIG. 5 is an illustrative representation of a locking arrangement in operation in accordance with embodiments of the present invention.

FIG. 5 is an illustrative representation of a locking arrangement in operation in accordance with embodiments of the present invention. As may be appreciated, container lid 410 may be utilized to seal container body 504. Locking tabs may be configured to engage a lock ridge 506 in some embodiments. As can be seen, lock ridge 506 may be disposed along container body's 504 wall. In some embodiments, lock ridge is contiguous. In other embodiments, lock ridge is non-contiguous. Lock ridge 506 may be configured with any number of contiguous or non-contiguous indents 502 (DETAIL A). As illustrated, indent 502 may be configured to capture lock nub 406 disposed on lock tab 404. In some examples, capturing lock nub 406 may result in a compressible gasket being at least partially compressed as noted above for FIGS. 2-3. Further, as noted above, lock tab 404 may be flexibly connected with lid 410 at juncture 408. As can be seen, configurations described herein may provide a reliable locking mechanism which, when used in coordination with a compressible gasket, my result in a sealing container that is easily sanitized.

While this invention has been described in terms of several embodiments, there are alterations, permutations, and equivalents, which fall within the scope of this invention. It should also be noted that there are many alternative ways of implementing the methods and apparatuses of the present invention. It is therefore intended that the following appended claims be interpreted as including all such alterations, permutations, and equivalents as fall within the true spirit and scope of the present invention.

What is claimed is:

1. A nano-silver infused container arrangement comprising:

a nano-silver infused container body defining at least one opening; and a nano-silver infused container lid configured to close off the at least one opening, wherein the container body and the container lid are made of a polymeric compound, and wherein the polymeric compound is rendered nonporous by infusing the polymeric compound with a concentration of 6 to 30 ppm of nano-silver particles.

2. The arrangement of claim 1, wherein the container lid has a compressible gasket that is removably retained in a gasket channel by opposing concave surfaces.

3. The arrangement of claim 1, wherein the polymeric compound is selected from the group consisting of: polyvinyl-pyrrolidione, polypropylene and polycarbonate.

4. The arrangement of claim 1, wherein the container body includes a lock ridge, and wherein the container lid is attached to the container body by a lock tab that is flexibly connected to the container lid and engages the lock ridge.

5. A nano-silver infused container arrangement comprising:

a nano-silver infused container body defining at least one opening; and a nano-silver infused container lid configured to close off the at least one opening, wherein the nano-silver infused container lid comprises:

a lid top disposed along a first plane, the lid top having at least one lid top edge, at least one lid wall disposed substantially perpendicular to the first plane along the at least one lid top edge, the at least one lid wall having at least one contiguous lid wall edge, a gasket channel disposed along the at least one contiguous lid wall edge, the gasket channel defining, a channel opening, two opposing concave surfaces disposed substantially perpendicular to the channel opening, and a bottom surface disposed substantially perpendicular to the two opposing concave surfaces, and a compressible gasket disposed within the gasket channel and retained by the two opposing concave surfaces; and wherein, the nano-silver infused container body comprises:

a container bottom disposed along a second plane, the container bottom having at least one container bottom edge, at least one container wall disposed substantially perpendicular to the second plane along the at least one container bottom edge, the at least one container wall having at least one contiguous container wall edge, and a sealing ridge configured to engage the compressible gasket through the channel opening.

6. The arrangement of claim 5 wherein the arrangement is a composition of at least one polymeric compound and a first concentration of nano-silver particles.

7. The arrangement of claim 6 wherein the at least one polymeric compound is selected from the group consisting of: polyvinyl-pyrrolidione, polypropylene and polycarbonate.

8. The arrangement of claim 6 wherein the first concentration is 6 to 30 ppm.

9. The arrangement of claim 5 wherein the compressible gasket is configured with a cross-sectional profile selected from the group consisting of: a circle, an oval, a quadrilateral, and a polygon.

10. The arrangement of claim 5 wherein, the nano-silver infused container lid further comprises:

at least two locking tabs flexibly connected with the at least one contiguous lid wall edge, the at least two locking tabs each having at least one lock nub; and wherein, the nano-silver infused container body further comprises:

a lock ridge disposed along the at least one container wall, the lock ridge configured with at least two non-contiguous indents for capturing the at least one lock nub.

11. The arrangement of claim 10 wherein the arrangement is a composition of at least one polymeric compound and a first concentration of nano-silver particles.

12. The arrangement of claim 11 wherein the at least one polymeric compound is selected from the group consisting of: polyvinyl-pyrrolidione, polypropylene and polycarbonate.

13. The arrangement of claim 11 wherein the first concentration is 6 to 30 ppm.

14. A nano-silver infused container arrangement comprising:

a nano-silver infused container body defining at least one opening comprising, a container bottom disposed along a first plane, the container bottom having at least one container bottom edge, at least one container wall disposed substantially perpendicular to the first plane along the at least one container bottom edge, the at least one container wall having at least one contiguous container wall edge, a sealing ridge, and a lock ridge disposed along the at least one container wall, the lock ridge configured with at least two non-contiguous indents; and a nano-silver infused container lid configured to close off the at least one opening comprising:

a lid top disposed along a second plane, the lid top having at least one lid top edge, at least one lid wall disposed substantially perpendicular to the second plane along the at least one lid top edge, the at least one lid wall having at least one contiguous lid wall edge, a gasket channel disposed along the at least one contiguous lid wall edge, the gasket channel defining, a channel opening for receiving the sealing ridge, two opposing concave surfaces disposed substantially perpendicular to the channel opening, and a bottom surface disposed substantially perpendicular to the two opposing concave surfaces, a compressible gasket for engaging the sealing ridge, the compressible gasket disposed within the gasket channel and retained by the two opposing concave surfaces, and at least two locking tabs flexibly connected with the at least one contiguous lid wall edge, the at least two locking tabs each having at least one lock nub for engaging the at least two non-contiguous indents.

15. The arrangement of claim 14 wherein the arrangement is a composition of at least one polymeric compound and a first concentration of nano-silver particles.

16. The arrangement of claim 15 wherein the at least one polymeric compound is selected from the group consisting of: polyvinyl-pyrrolidione, polypropylene and polycarbonate.

17. The arrangement of claim 15 wherein the first concentration is 6 to 30 ppm.

* * * * *